US006290556B1

(12) United States Patent
Howland et al.

(10) Patent No.: US 6,290,556 B1
(45) Date of Patent: Sep. 18, 2001

(54) TWO PIECE MALE PIN TERMINAL CONNECTOR

(75) Inventors: Jeffrey C. Howland, Spartanburg; Robert M. Petroskie, Inman, both of SC (US)

(73) Assignee: Thomas & Betts International, Inc., Sparks, NV (US)

( * ) Notice: Subject to any disclaimer, the term of this patent is extended or adjusted under 35 U.S.C. 154(b) by 0 days.

(21) Appl. No.: 09/452,349

(22) Filed: Dec. 1, 1999

Related U.S. Application Data

(60) Provisional application No. 60/110,819, filed on Dec. 1, 1998.

(51) Int. Cl.[7] ..... H01R 4/10

(52) U.S. Cl. ..... 439/879; 439/891

(58) Field of Search ..... 439/877, 882, 439/891, 879, 878, 880, 881

(56) References Cited

U.S. PATENT DOCUMENTS

| | | | | |
|---|---|---|---|---|
| 1,575,656 | | 3/1926 | Stratford et al. . | |
| 3,517,437 | | 6/1970 | Szobonya | 29/624 |
| 3,594,702 | | 7/1971 | Frey | 339/95 R |
| 3,812,448 | | 5/1974 | Haitmanek | 339/97 C |
| 3,892,459 | | 7/1975 | Dittmann et al. | 339/95 R |
| 3,976,385 | | 8/1976 | Klopfer | 403/284 |
| 4,072,394 | | 2/1978 | Waldron et al. | 339/276 T |
| 4,120,556 | | 10/1978 | Waldron et al. | 339/142 |
| 4,142,771 | | 3/1979 | Barnes et al. | 339/95 R |
| 4,150,355 | | 4/1979 | Neff et al. | 338/332 |
| 4,253,234 | * | 3/1981 | Niles et al. | 439/891 |
| 5,387,138 | * | 2/1995 | O'Malley | 439/891 |
| 5,399,110 | | 3/1995 | Morello et al. | 439/879 |
| 5,730,629 | | 3/1998 | Samjima et al. | 439/855 |
| 5,755,599 | | 5/1998 | Hotea | 439/745 |
| 5,993,272 | * | 11/1999 | Wood et al. | 439/879 |
| 6,004,172 | * | 12/1999 | Kerek | 439/879 |

* cited by examiner

*Primary Examiner*—Renee Luebke
*Assistant Examiner*—Briggitte R. Hammond
(74) *Attorney, Agent, or Firm*—Hoffmann & Baron, LLP

(57) ABSTRACT

A two-piece male pin terminal connector for mechanically and electrically connecting an insulated electrical cable having a conductor core to a terminal cavity is provided. The connector includes an electrically conductive contact member having an elongated cylindrically shaped pin formed along a forward portion of the contact member and a flattened portion formed at a rearward portion of the contact member. The flattened portion has a slightly arcuate shape for establishing electrical contact between the contact member and the conductor core in the insulated electrical cable. The flattened portion further includes a plurality of transversely extending grooves on an upper surface thereof and a plurality of transversely extending ribs on a lower surface thereof. The pin further includes a first clamping portion adjacent the flattened portion which includes at least one annular groove. The connector further includes an electrically conductive crimp saddle attachment member formed from a sheet metal blank. The attachment member includes a generally rectangular first attachment portion formed at its forward most end for receiving and engaging the first clamping portion of the pin. The first attachment portion includes at least one transversely extending rib for engaging the at least one annular groove in the first clamping portion wherein the first attachment portion is tightly rolled and formed into a generally cylindrical shape around the first clamping portion so as to secure the contact member to the attachment member. The attachment member further includes a generally rectangular core crimp portion which is fashioned to form an open generally U-shaped channel for receiving the flattened portion of the contact member and the conductor core of the insulated electrical cable. The core crimp portion further includes a plurality of transversely extending grooves for engaging said plurality of transversely extending ribs on the lower surface of the flattened portion wherein the core crimp portion is crimped onto the conductor core and the flattened portion so as to press the conductor core into the plurality of transversely extending grooves on the upper surface of the flattened portion thereby making electrical connection between the conductor core and the contact member.

15 Claims, 5 Drawing Sheets

TWO PIECE MALE PIN TERMINAL CONNECTOR

Cross-Reference To Related Applications

This application claims priority under 35 U.S.C. §119(e) to provisional patent application Ser. No. 60/110,819 filed Dec. 1, 1998, the disclosure of which is incorporated herein by reference.

FIELD OF THE INVENTION

The present invention relates generally to the field of joining electrical conductors to electrical terminals, and more specifically, to male pin terminal connectors. In even greater particularity, the present invention is directed to an improved two-piece solid male pin to crimp saddle terminal connector and method of manufacture.

BACKGROUND OF THE INVENTION

A multitude of approaches have been taken to join electrical conductors to terminal connectors. In order to construct a typical male pin terminal connector, the insulation must be removed from a portion of the conductor to permit contact between the metallic wire barrel of the connector and the uninsulated portion of the conductor. Joinder of the connector and conductor is accomplished by externally applied mechanically deforming forces to make a mechanical and electrical coupling between the conductor and connector. Another method of constructing a male pin terminal connector is described in U.S. Pat. No. 5,399,110. However, although the above techniques may be satisfactory for some purposes, the strength of such connectors has been noted to be unreliable in some applications. Accordingly, there is a need for a male pin terminal connector having reliable and improved strength, yet is inexpensive and easy to manufacture.

SUMMARY OF THE INVENTION

In accordance with the purposes of the invention as embodied and broadly described herein, the present invention addresses the above need by providing one embodiment which is directed to an electrically conductive contact member for use in a two-piece male pin terminal connector whereby electrical conductors in an insulated electrical cable are mechanically and electrically connected to a terminal cavity. The contact member includes an elongated cylindrically shaped solid pin formed along a forward portion of the contact member. The pin may further include a rounded point at its forward most end to facilitate insertion of the contact member into the terminal cavity. A flattened portion is formed at a rearward portion of the contact member which has a slightly arcuate shape for establishing electrical contact between the contact member and the electrical conductors in the insulated electrical cable. The flattened portion further includes a plurality of transversely extending grooves on an upper surface thereof and a plurality of transversely extending ribs on a lower surface thereof The pin further includes at least one clamping portion adjacent the flattened portion which includes at least one annular groove. The clamping portion on the pin may include two annular grooves. The pin may include two clamping portions adjacent the flattened portion. The lower surface of the flattened portion may further include an extruded post.

Another embodiment of the present invention is directed to an electrically conductive crimp saddle attachment member for use in a two-piece male pin terminal connector having a male contact member whereby an insulated electrical cable having a conductor core is mechanically and electrically connected to a terminal cavity. The attachment member includes a generally rectangular first attachment portion formed at a forward most end of the attachment member. The first attachment portion includes at least one transversely extending rib for engaging the male contact member, wherein the first attachment portion is tightly rolled and formed into a generally cylindrical shape around the male contact member so as to secure said male contact member to the attachment member. The attachment member further includes a winged connect portion adjacent the first attachment portion. The winged connect portion is manipulated about the male contact member to form a generally triangular shaped configuration having first and second wings which taper away from the longitudinal axis of the male contact member wherein the wings operate to secure the two-piece male pin terminal connector to the terminal cavity. The attachment member further includes a second generally rectangular attachment portion adjacent the winged connect portion wherein the first attachment portion is tightly rolled and formed into a generally cylindrical shape around the male contact member so as to further secure the male contact member to the attachment member. The attachment member further includes a generally rectangular core crimp portion adjacent the second generally rectangular attachment portion. The core crimp portion is fashioned to form an open generally U-shaped channel for receiving the male contact member and the conductor core of the electrical cable. The core crimp portion further includes a plurality of transversely extending grooves for engaging the male contact member. The attachment member further includes a generally rectangular insulation crimp portion adjacent the core crimp portion wherein the insulation crimp portion is fashioned to form an open generally U-shaped channel for receiving the insulated electrical cable. In this particular embodiment, the attachment member may be formed from a sheet metal blank.

In another embodiment of the present invention, a two-piece male pin terminal connector for mechanically and electrically connecting an insulated electrical cable having a conductor core to a terminal cavity is provided. The connector includes an electrically conductive contact member having an elongated cylindrically shaped pin formed along a forward portion of the contact member and a flattened portion formed at a rearward portion of the contact member. The flattened portion has a slightly arcuate shape for establishing electrical contact between the contact member and the conductor core in the insulated electrical cable. The flattened portion further includes a plurality of transversely extending grooves on an upper surface thereof and a plurality of transversely extending ribs on a lower surface thereof. The pin further includes a first clamping portion adjacent the flattened portion wherein the first clamping portion includes at least one annular groove. The connector further includes an electrically conductive crimp saddle attachment member formed from a sheet metal blank. The attachment member includes a generally rectangular first attachment portion formed at its forward most end for receiving and engaging the first clamping portion of the pin. The first attachment portion includes at least one transversely extending rib for engaging the at least one annular groove in the first clamping portion wherein the first attachment portion is tightly rolled and formed into a generally cylindrical shape around the first clamping portion so as to secure the contact member to the attachment member. The attachment member further includes a generally rectangular core crimp portion which is fashioned to form an open generally U-shaped channel for receiving the flattened portion of the contact member and the conductor core of the insulated electrical cable. The core crimp portion further includes a plurality of transversely extending grooves for engaging said plurality of transversely extending ribs on the lower surface of the flattened portion wherein the core crimp portion is crimped onto the conductor core and the flattened portion so as to press the conductor core into the plurality of transversely extending grooves on the upper surface of the flattened portion thereby making electrical connection between the conductor core and the contact member. The lower surface of the flattened portion may further include an extruded post. The core crimp portion may further include a hole formed in the bottom of the U-shaped channel for receiving the extruded post on the lower surface of the flattened portion. The extruded post may be coined down so as to form a flange which engages the core crimp portion at locations surrounding the hole thereby further enhancing the securing of the contact member to the attachment member. The pin may further include a second clamping portion adjacent the flattened portion. The attachment member may further include a second generally rectangular attachment portion adjacent the first attachment portion for receiving and engaging the second clamping portion of the pin wherein the second attachment portion is tightly rolled and formed into a generally cylindrical shape around the second clamping portion so as to further secure the contact member to the attachment member. The attachment member may further include a generally rectangular insulation crimp portion adjacent the core crimp portion. The insulation crimp portion is fashioned to form an open generally U-shaped channel for receiving the insulated electrical cable wherein the insulation crimp portion is crimped onto the insulated electrical cable thereby further enhancing the securing of the electrical cable to the attachment member. The attachment member may further include a winged connect portion adjacent the first attachment portion wherein the winged connect portion manipulated about the pin to form a generally triangular shaped configuration having first and second wings which taper away from the longitudinal axis of the pin, the wings operating to secure the connector to the terminal cavity. The pin may further include a rounded point at its forward most end to facilitate insertion of the contact member into the terminal cavity. The first clamping portion on the pin may include two annular grooves.

These and other objects, features, and advantages of the present invention will become more fully apparent from the following description and appended claims, or may be learned by the practice of the invention as set forth hereinafter.

BRIEF DESCRIPTION OF THE DRAWINGS

In order to more fully understand the manner in which the above-recited and other advantages and objects of the invention are obtained, a more particular description of the invention will be rendered by reference to specific embodiments thereof which are illustrated in the appended drawings. Note particularly that the appended drawings are not necessarily drawn to scale. Understanding that these drawings depict only typical embodiments of the invention and are not therefore to be considered to be limiting of its scope, the invention and its presently understood best mode for making and using the same will be described and explained with additional specificity and detail through the use of the accompanying drawings in which.

DETAILED DESCRIPTION

Figure 1:
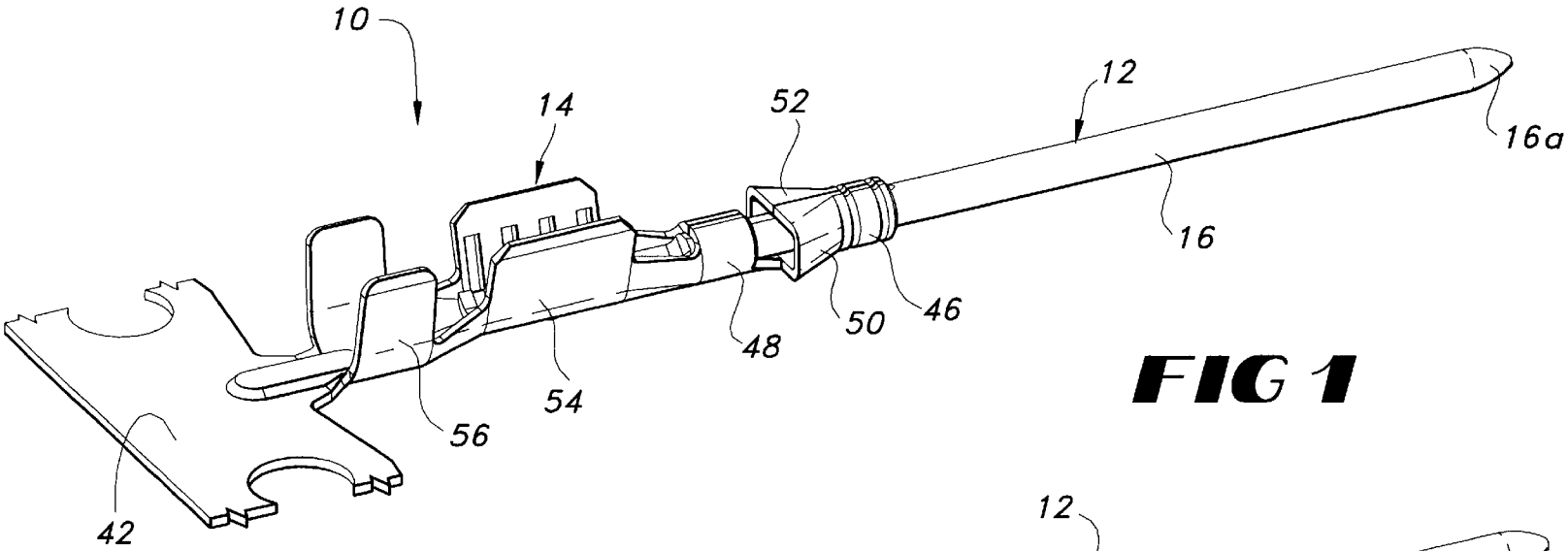
FIG. 1 is a top perspective view of a two-piece male pin terminal connector embodying characteristics of the present invention.
Figure 2:
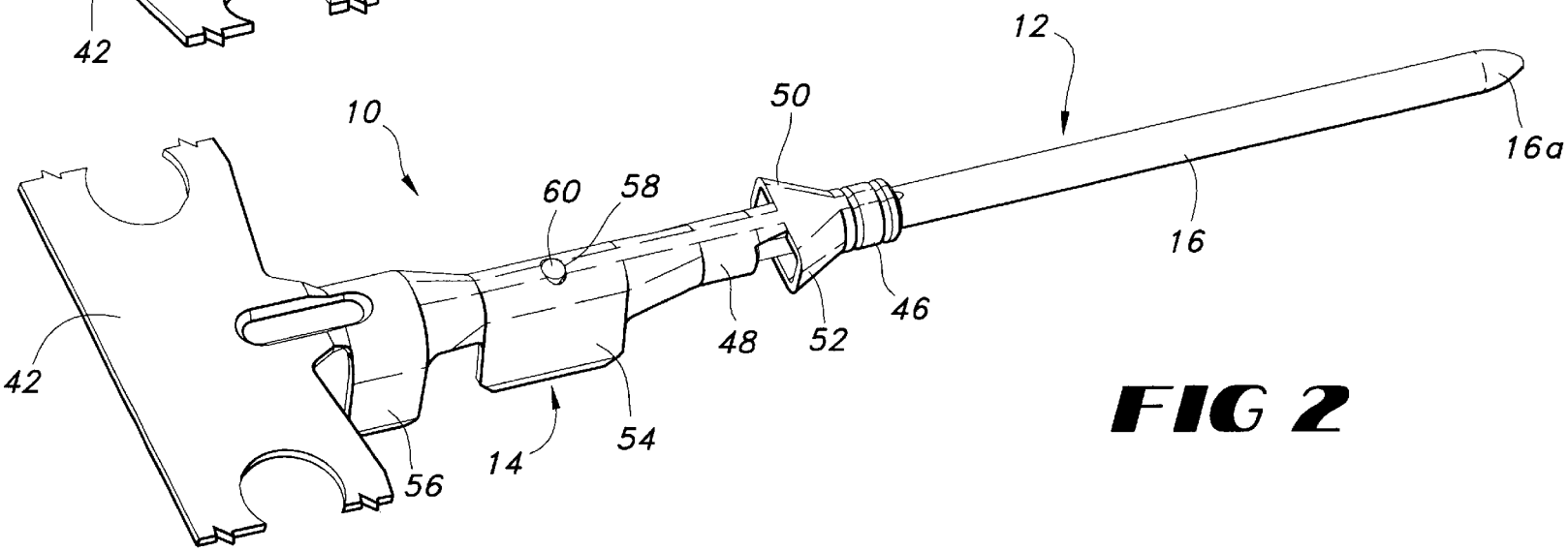
FIG. 2 is a bottom perspective view of the two-piece male pin terminal connector of FIG. 1 embodying characteristics of the present invention.

Referring to the drawings for a better understanding of the present invention, a representative male pin terminal connector is generally indicated throughout the figures by reference numeral 10. Connector 10 is preferably of two piece construction comprising a contact member 12 and a crimp saddle attachment member 14, both of which are made of an electrically conductive material, such as brass.

Figure 6:
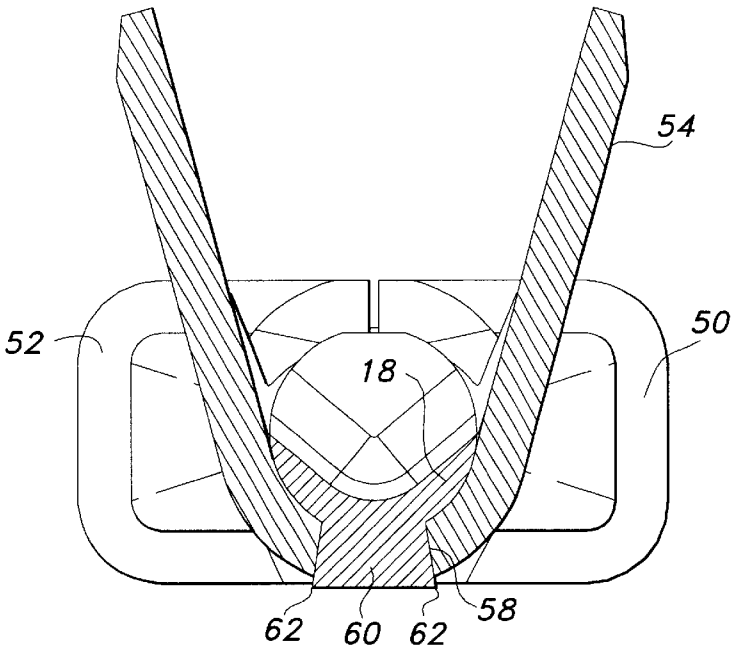
FIG. 6 is an enlarged end cross-sectional view of the core crimp saddle portion of the two-piece male pin terminal taken approximately along line 6—6 of FIG. 3 embodying characteristics of the present invention.
Figure 7:
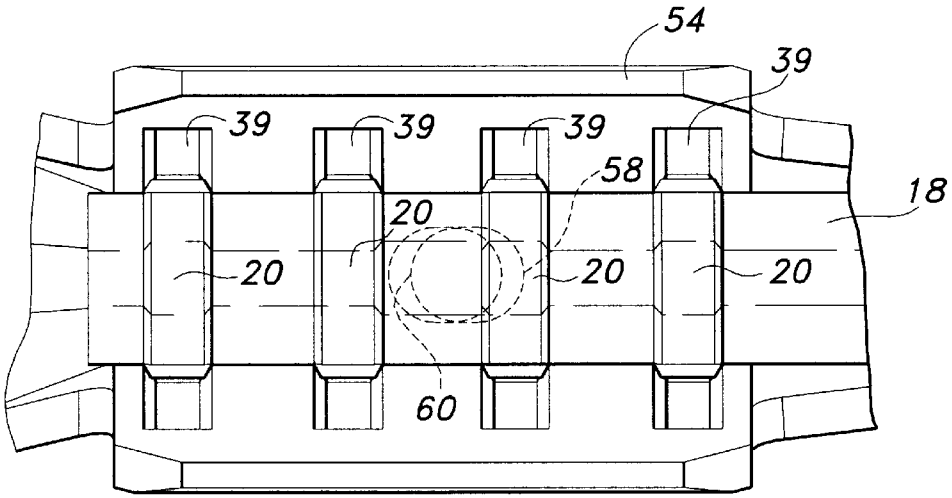
FIG. 7 is an enlarged fragmentary top plan view of the core crimp saddle portion of the two-piece male pin terminal of FIG. 1 embodying characteristics of the present invention.
Figure 8:
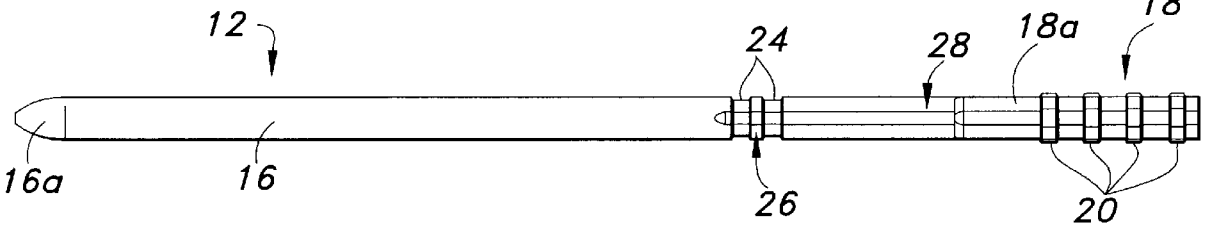
FIGS. 8 and 9 are, respectively, top and side elevational views of a contact member of the two-piece male pin terminal of FIG. 1 embodying characteristics of the present invention.
Figure 9:
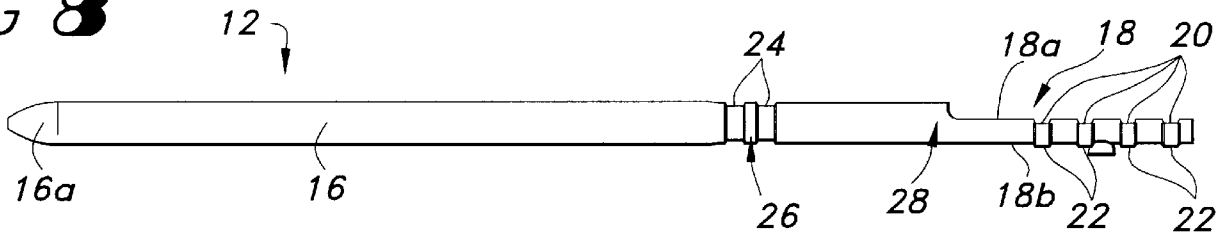

In a preferred embodiment, contact member 12 has a round or cylindrically shaped solid pin 16 along its forward portion. Pin 16 includes a rounded point 16*a* at its forward most end to facilitate insertion of the male pin connector 10 into a terminal cavity (not shown) and through sealing holes and membranes of an insert (not shown). At its rearward portion, the contact member 12 includes a flattened and dished portion 18 which is slightly arcuate in shape, as best shown in FIGS. 6, 8 and 9, for establishing good electrical contact between the contact member 12 and the conductive core of an electrical conductor cable (not shown) when the male pin connector 10 is attached to the core of an insulation end of the cable. Flattened portion 18 includes a plurality of transversely extending grooves 20 on its upper surface 18*a* and a plurality of transversely extending ribs 22 on its lower surface 18*b*. Pin 16 further includes at least one clamping portion 26 adjacent flattened portion 18 which includes at least one annular groove 24. A second clamping portion 28 may be formed with or without annular grooves 24.

Figure 10:
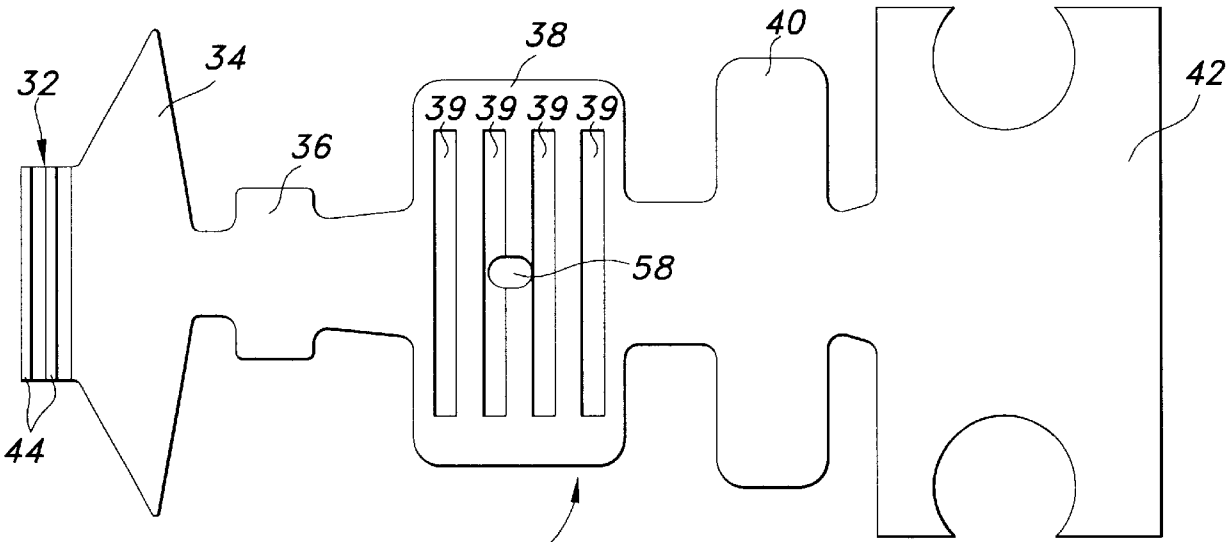
FIG. 10 is a top plan view of a metal blank for forming an attachment member of the two-piece male pin terminal of FIG. 1 embodying characteristics of the present invention.
Figure 11:
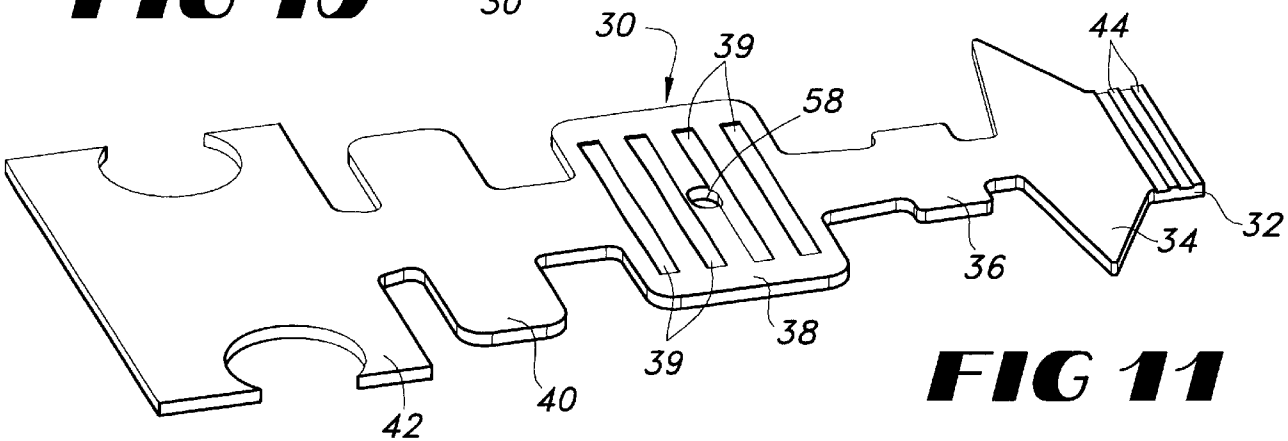
FIG. 11 is a top perspective view of the metal blank of FIG. 10 embodying characteristics of the present invention.

The attachment member 14 is made from a sheet metal blank 30 stamped to the configuration shown in FIGS. 10 and 11. In a preferred embodiment, the stamped blank 30 may have a generally rectangular first attachment portion 32 at its forward most end, a "winged" connect portion 34 adjacent first attachment portion 32, a second generally rectangular attachment portion 36, a generally rectangular core crimp portion 38, a generally rectangular insulation crimp portion 40, and a carrier strip portion 42 at its rearward most end. The first attachment portion 32 includes at least one transversely extending rib 44. The core crimp portion 38 includes a plurality of transversely extending grooves 39.

Figure 3:
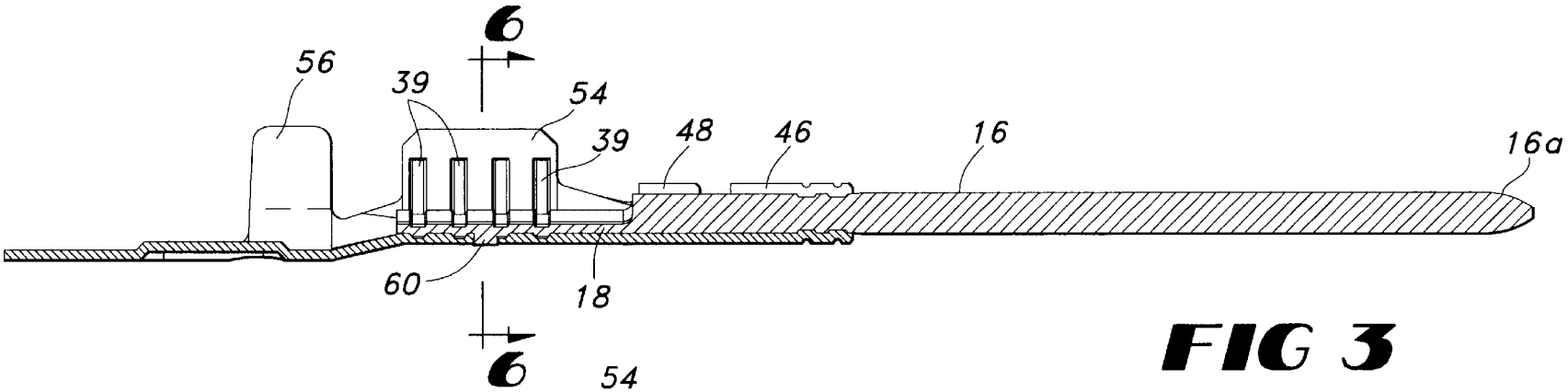
FIG. 3 is a side-sectional view of the two-piece male pin terminal connector of FIG. 1 embodying characteristics of the present invention.
Figure 4:
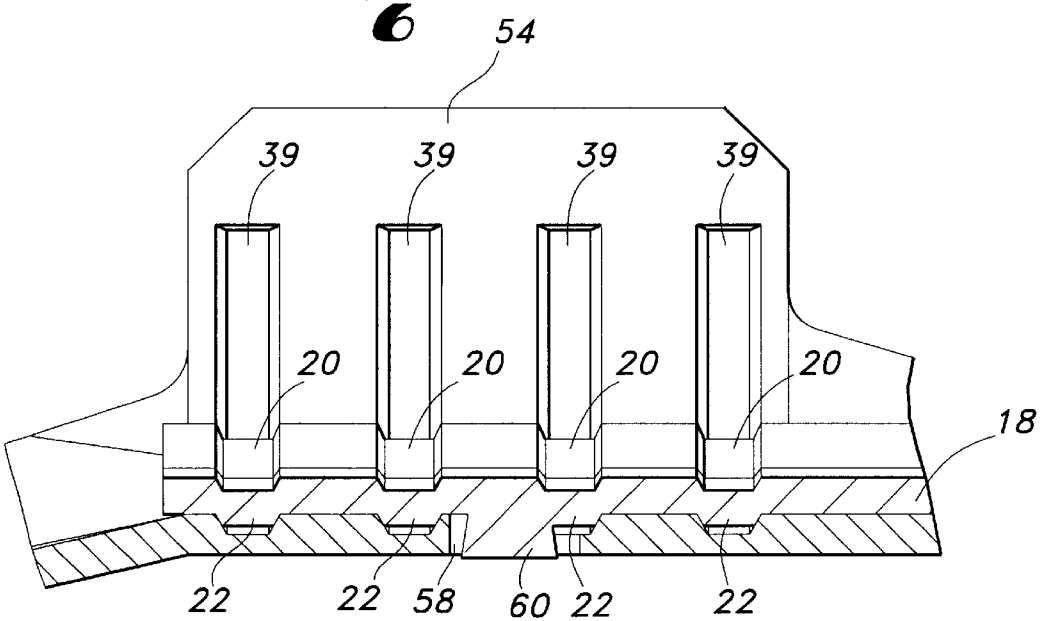
FIG. 4 is an enlarged fragmentary side-sectional view a core crimp saddle portion of the two-piece male pin terminal connector of FIG. 1 embodying characteristics of the present invention.
Figure 5:
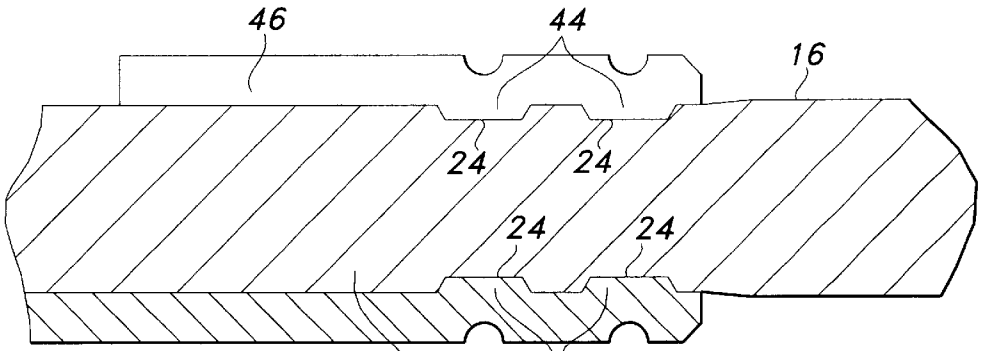
FIG. 5 is an enlarged fragmentary side-sectional view of an attachment portion of the two-piece male pin terminal of FIG. 1 embodying characteristics of the present invention.

In order to form the male pin connector 10 of the present invention, the first 32 and second 36 attachment portions of attachment blank 30 are tightly rolled and formed into cylinders 46 and 48, respectively, around clamping portions 26 and 28 of pin 16, respectively. Such manipulation of portions 32 and 36 around pin 16 constitutes a first and second means of retaining contact member 12 in the attachment member 14, respectively. As best illustrated in FIGS. 3 and 5, an important aspect of the first retaining means is that the ribs 44 on the first attachment portion 32 of attachment member 14 engage the corresponding annular grooves 24 in the first clamping portion 26 of pin 16 which enhances the connection or engagement between the two.

The connect portion 34 of blank 30 is also rolled or manipulated about pin 16 to form a generally "triangular" or "arrow" shaped configuration having first 50 and second 52 wings which taper away and are spaced from the longitudinal axis of pin 16. Wings 50 and 52 are instrumental in attaching and securing connector 10 in an insulator connector housing (not shown). Thus, with the present invention, a primary retention feature of connector 10 in an insulator housing is accomplished by connect portion 34 of blank 30 after first and second wings 50, 52 have been formed. By using the attachment member 14 as a retention member, as opposed to using the contact member 12, connector 10 eliminates the stress between the contact member 12 and attachment member 14 encountered when axial forces are introduced to the electrical conductor cable. More retention force may be withstood by the attachment member 14 than by the contact member 12 which has minimal load.

Referring to FIGS. 1–4 and 6, the core and insulation crimp portions 38, 40 of blank 30 are bent to form open generally U-shaped channels 54, 56, respectively. During assembly, the flattened portion 18 of contact member 12 is positioned in the bottom of the channel 54 so that the plurality of transversely extending ribs 22 on the lower surface 18*b* of flattened portion 18 are received in and engage the corresponding plurality of transversely extending grooves 39 in channel 54. Next, the core of an electrical cable is pressed against the grooved upper surface 18*a* of portion 18 and the channel 54 is crimped onto the core. At approximately the same time, the portion of the electrical cable still having insulation around the core is placed in the bottom of channel 56 whereupon channel 56 is crimped onto the insulation in a conventional manner.

Another important aspect of the present invention is the manner in which the flattened portion 18 is retained in channel 54 which constitutes a third means of retaining contact member 12 in the attachment member 14. As best shown in FIGS. 2, 4, 6–7 and 10–11, in a preferred embodiment, a hole 58 is stamped in the bottom of saddle channel 54. Next, a post 60 is extruded from the lower surface 18*b* of flattened portion 18. During assembly, the post 60 and hole 58 are aligned with each other so that hole 58 receives post 60. Next, the post 60 is peened or coined down forming a flange 62 which engages the saddle channel 54 at locations surrounding the hole 58 to securely retain the attachment member 14 to the contact member 12 and to stabilize the connection axially and in all directions. By extruding the post 60 from the lower surface 18*b* of flattened portion 18 and peening the post inside the hole 58 previously stamped in the bottom of the wire crimp saddle channel 54, additional strength is gained in the saddle/channel area in the uncrimped and crimped state. This becomes evident if the contact member 12 and attachment member 14 are inadvertently bent or experience forces in the saddle/channel area. Moreover, by extruding and peening a post into a blanked hole, as opposed to a hole created on a seam, the likelihood of the post pulling out of location is greatly reduced. This also insures that the pin 16 remains in contact with the inside surface of the saddle/channel 54. In the alternative, the flattened portion 18 may be positioned in channel 54 and material punched from the upper surface 18*a* of flattened portion 18 into hole 58, the material that is punched forming post 60.

Although preferred embodiments of the present invention has been described above by way of example, it will be understood by those skilled in the field that modifications may be made to the disclosed embodiments which are within the scope of the invention as defined by the appended claims.

What is claimed is:

1. A two-piece male pin terminal connector for mechanically and electrically connecting an insulated electrical cable having a conductor core to a terminal cavity, said connector comprising:

(a) an electrically conductive contact member having an elongated cylindrically shaped pin formed along a forward portion of said contact member and a flattened elongated portion formed at a rearward portion of said contact member, said pin further including a first clamping portion spaced from said flattened portion, said first clamping portion having a rib and groove structure, said flattened portion comprising a rib and groove structure adjacent an end thereof; and (b) an electrically conductive crimp saddle attachment member comprising a first attachment portion and a core crimp portion, said first attachment portion comprising a rib and groove structure for engaging said rib and groove structure of said first clamping portion of said pin, said core crimp portion comprising a rib and groove structure for engaging said rib and groove structure of said flattened portion of said contact member.

2. The two-piece male pin terminal connector of claim 1, wherein said flattened portion has a slightly arcuate shape for establishing electrical contact between said contact member and the conductor core in the insulated electrical cable.

3. The two-piece male pin terminal connector of claim 1, wherein said first attachment portion is formed at its forward most end for receiving and engaging said first clamping portion of said pin.

4. The two-piece male pin terminal connector of claim 1, wherein said first attachment portion is tightly rolled and formed into a generally cylindrical shape around said first clamping portion so as to secure said contact member to said attachment member.

5. The two-piece male pin terminal connector of claim 1, wherein said core crimp portion is crimped onto the conductor core and said flattened portion so as to press the conductor core into an upper surface of said flattened portion thereby making an electrical connection between the conductor core and said contact member.

6. The two-piece male pin terminal connector of claim 1, wherein said attachment member further includes a second generally rectangular attachment portion adjacent said first attachment portion for receiving and engaging said second clamping portion of said pin, wherein said second attachment portion is tightly rolled and formed into a generally cylindrical shape around said second clamping portion so as to further secure said contact member to said attachment member.

7. The two-piece male pin terminal connector of claim 1, wherein said attachment member further includes a generally rectangular insulation crimp portion adjacent said core crimp portion, said insulation crimp portion fashioned to form an open generally U-shaped channel for receiving the insulated electrical cable, wherein said insulation crimp portion is crimped onto the insulated electrical cable thereby further enhancing the securing of the electrical cable to said attachment member.

8. The two-piece male pin terminal connector of claim 1, wherein said attachment member further includes a winged connect portion adjacent said first attachment portion, said winged connect portion manipulated about said pin to form a generally triangular shaped configuration having first and second wings which taper away from the longitudinal axis of said pin, said wings operating to secure said connector to the terminal cavity.

9. The two-piece male pin terminal connector of claim 1, wherein said pin further includes a rounded point at its forward most end to facilitate insertion of said contact member into the terminal cavity.

10. The two-piece male pin terminal connector of claim 1, wherein said first clamping portion on said pin includes two annular grooves.

11. The two-piece male pin terminal connector of claim 1, wherein said attachment member is formed from a sheet metal blank.

12. The two-piece male pin terminal connector of claim 1, wherein said attachment member further includes a generally rectangular core crimp portion which is fashioned to form an open generally U-shaped channel for receiving said flattened portion of said contact member and the conductor core of the insulated electrical cable.

13. The two-piece male pin terminal connector of claim 12, wherein said flattened portion further includes an extruded post on a lower surface thereof.

14. The two-piece male pin terminal connector of claim 13, wherein said core crimp portion further includes a hole formed in a bottom surface of said U-shaped channel for receiving said extruded post on said lower surface of said flattened portion.

15. The two-piece male pin terminal connector of claim 14, wherein said extruded post is coined down so as to form a flange which engages said core crimp portion at locations surrounding said hole thereby further enhancing the securing of said contact member to said attachment member.

* * * * *